US009829199B2

(12) United States Patent
Mayer

(10) Patent No.: US 9,829,199 B2
(45) Date of Patent: Nov. 28, 2017

(54) FLANGE WITH CURVED CONTACT SURFACE

(71) Applicant: Siemens Energy, Inc., Orlando, FL (US)

(72) Inventor: Clinton A. Mayer, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 464 days.

(21) Appl. No.: 14/527,843

(22) Filed: Oct. 30, 2014

(65) Prior Publication Data

US 2016/0123231 A1 May 5, 2016

(51) Int. Cl.
*F23R 3/28* (2006.01)
*F23R 3/60* (2006.01)

(52) U.S. Cl.
CPC ..... *F23R 3/28* (2013.01); *F23R 3/60* (2013.01); *F23R 2900/00017* (2013.01)

(58) Field of Classification Search
CPC .... F23R 3/28; F23R 3/60; F23R 2900/00017; F16L 23/032
USPC ..... 60/740; 285/412
See application file for complete search history.

(56) References Cited

U.S. PATENT DOCUMENTS 2,239,307 A 4/1941 Weber
2,461,856 A * 2/1949 Tornberg ..... B29C 47/12 285/261
2,564,938 A * 8/1951 Warren ..... F16L 27/047 277/507
3,165,339 A * 1/1965 Faccon ..... F16L 27/04 277/507
3,315,971 A 5/1966 Sakurada
3,477,748 A * 11/1969 Tinsley ..... E21B 43/127 285/267
4,180,285 A 12/1979 Reneau
4,530,526 A * 7/1985 Dopyera ..... F16L 27/053 285/261
4,678,211 A 7/1987 Bateman et al.
4,840,409 A * 6/1989 Welkey ..... F16L 1/26 277/625
4,840,410 A * 6/1989 Welkey ..... F16L 1/26 277/625
5,368,342 A 11/1994 Latham et al.
6,158,781 A * 12/2000 Aaron ..... F16L 27/053 285/23
6,419,279 B1 * 7/2002 Latham ..... F16L 23/036 285/261
6,886,346 B2 * 5/2005 Sobieski ..... F02C 7/22 60/776

(Continued)

*Primary Examiner* — Jason Shanske
*Assistant Examiner* — Jason T Newton

(57) ABSTRACT

A flange (28A-C, 28E, 30A-E) with a primary contact surface (29B-C, 31B-D) that is curved (C) in a section plane (P) normal to a direction of the flange around a perimeter (60) of a component. The curve may have a maximum departure (D), from a straight line drawn between the ends (34, 35) of the curve, of at least 5% of a length of the straight line. The curve may be a circular arc with a span angle (A) of at least 40 degrees. The primary contact surface (29C, 31C) may be defined by an annular portion of a torus. Alternately, the primary contact surface (31D) may follow a non-circular perimeter path. A toric or other non-planar flange interface (32A-B) may be formed by mating contact surfaces on first (22, 36) and second (24, 38) components.

19 Claims, 3 Drawing Sheets

(56) References Cited

U.S. PATENT DOCUMENTS

| | | | | |
|---|---|---|---|---|
| 7,144,049 | B2 * | 12/2006 | Stangeland | F16L 27/1012 285/261 |
| 7,249,461 | B2 | 7/2007 | Moraes | |
| 7,290,806 | B2 * | 11/2007 | Pichel | F01D 5/026 285/412 |
| 7,350,833 | B2 | 4/2008 | Bongiorno | |
| 7,380,842 | B1 | 6/2008 | Stangeland et al. | |
| 7,490,868 | B2 * | 2/2009 | Prestridge | F16L 23/162 285/263 |
| 8,079,773 | B2 * | 12/2011 | Blanton | B29C 65/562 403/335 |
| 8,490,400 | B2 | 7/2013 | Koenig et al. | |
| 2003/0234541 | A1 * | 12/2003 | Thompson | F16L 23/0283 285/412 |
| 2004/0046391 | A1 * | 3/2004 | Vasudeva | F01N 13/16 285/368 |
| 2005/0129457 | A1 * | 6/2005 | Webjorn | F16L 23/032 403/183 |
| 2008/0084065 | A1 * | 4/2008 | Ogimura | F16L 27/1012 285/369 |
| 2011/0074150 | A1 | 3/2011 | Drost et al. | |
| 2011/0185487 | A1 * | 8/2011 | Miller | E03D 11/16 4/252.5 |
| 2011/0185488 | A1 * | 8/2011 | Miller | E03D 11/17 4/252.6 |

* cited by examiner

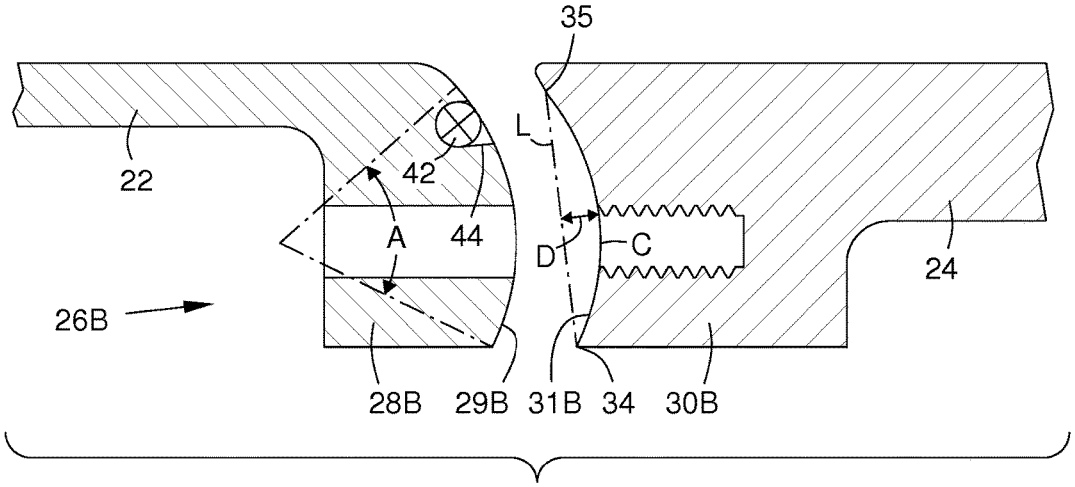
FIG 4
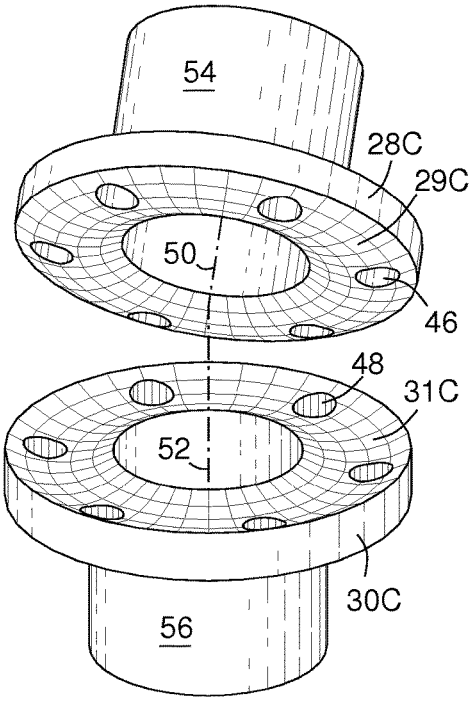
FIG 5
FIG 6
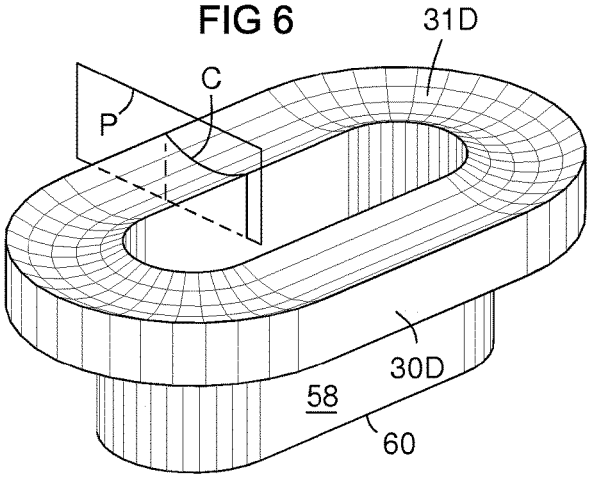

FLANGE WITH CURVED CONTACT SURFACE

FIELD OF THE INVENTION

This invention relates to flange connections and seals between structures in general, and between fluid communication and containment structures in particular.

BACKGROUND OF THE INVENTION

Connection flanges normally provide a planar interface between structural and/or fluid communication and containment elements. However, a planar interface does not provide self-centering. Centering has been achieved with body-bound bolts with tight clearance, but this can cause stuck bolts and differential expansion stress. Spigots have been used in which a component has an annular lip that is received in the end of an opposed component for centering. Standardized planar flange interfaces also allow unauthorized third party components to be used in an assembly.

BRIEF DESCRIPTION OF THE DRAWINGS

The invention is explained in the following description in view of the drawings that show:

FIG. 4 is a view of the embodiment of FIG. 3 with the flanges separated.

FIG. 5 is a perspective view of exemplary geometry of toric flanges.

FIG. 6 is a perspective view of exemplary geometry of a flange around a non-circular periphery of a component.

DETAILED DESCRIPTION OF THE INVENTION

Figure 1:
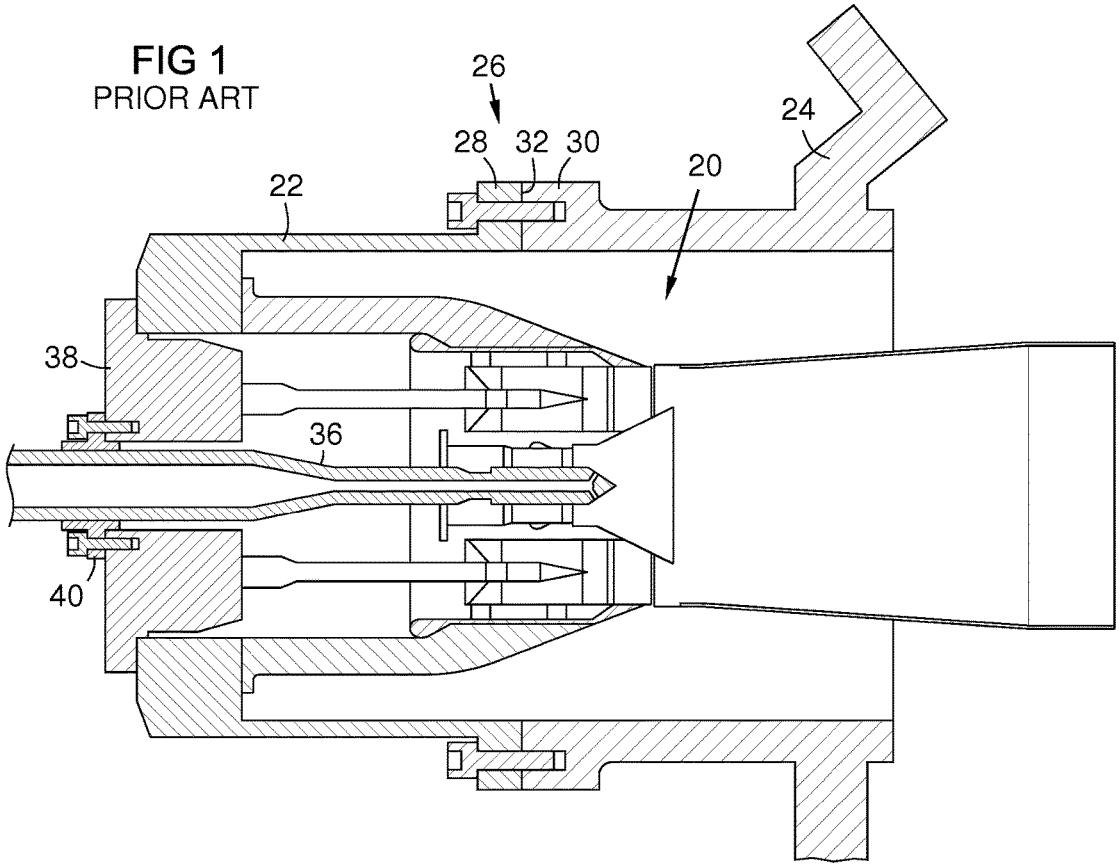
FIG 1 PRIOR ART
FIG. 1 is a sectional side view of a prior art gas turbine combustor with an outer casing attached to an engine casing by a bolted flange connection.

FIG. 1 shows a can-annular type combustor 20 of a gas turbine engine. The combustor has an outer casing 22, which is attached to another structure such as an engine casing 24 by a bolted flange connection 26 between a first flange 28 and a second flange 30 with a planar interface 32. The combustor may have a pilot nozzle 36 attached to a combustor head 38 by a bolted flange 40. Such prior art bolted flange connections 26, 40 may be improved by designs taught below.

Figure 2:
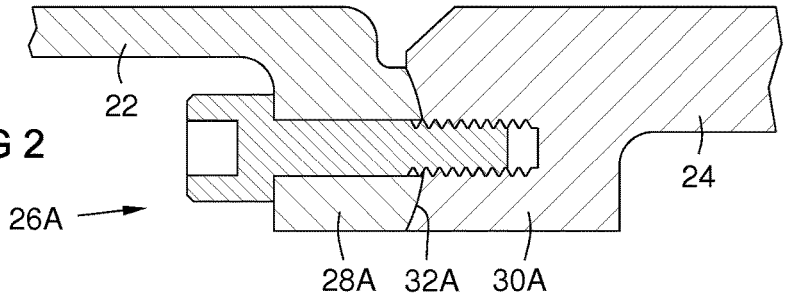
FIG. 2 is a sectional side view of a bolted flange connection with a curved interface according to aspects of an embodiment of the invention.

FIG. 2 shows a connection 26A between a first flange 28A and a second flange 30A with a curved interface 32A, which may be toric. "Toric" herein means an annular portion of a surface of revolution of a curve—for example an annular portion of a surface of revolution of a circle or ellipse about an axis in the plane of the circle or ellipse that does not intersect the circle or ellipse. A compliant gasket (not shown) may be provided in the interface 32B as known in the art of engine gaskets.

Figure 3:
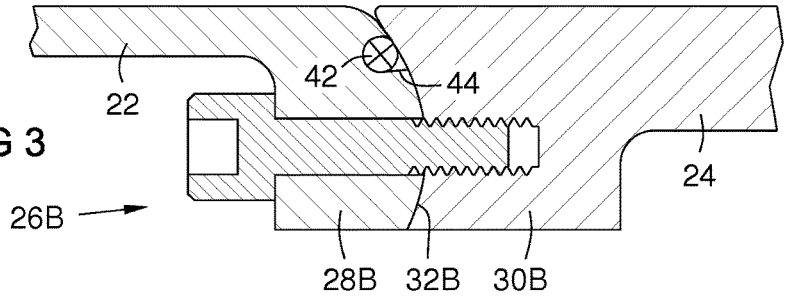
FIG. 3 is a sectional side view of a bolted flange connection with a curved interface and a ring seal according to aspects of an embodiment of the invention.

FIG. 3 shows a flange connection 26B with a curved interface 32B between a first flange 28B and a second flange 30B. This embodiment has a ring seal 42 in a seal slot 44 in the first or second flange.

The curved interface provides the following benefits:

a) Greater contact area than a corresponding planar interface with the same inner and outer peripheries. This decreases fluid leakage by increasing resistance to flow by increasing the length of the leakage path.

b) Self centering and alignment of the opposed structures 22, 24, without the need for spigots or body-centered bolts. Centering and alignment is important for reliable, repeatable assembly of gas turbine engine components for maintenance.

c) Exclusion of outdated or unauthorized replacement parts that do not have the matching curved contact surface.

FIG. 4 shows flanges 28B, 30B separated for clarity. Each flange has a curved primary contact surface 29B, 31B. "Primary" means a contact surface of the interface 32B (FIG. 3), as distinct from a secondary surface such as the ring seal slot 44, which may also be toric. The primary contact surfaces 29B, 31B are curved C as seen in an axial section of each flange as shown. "Axial" means related to the rotation axis of a surface of revolution 29B, 31B. An axial section plane is a plane of the axis of revolution of the surface 29B, 31B. The curve C defining a primary contact surface in an axial section may be a circular arc with a span angle A of at least 40 degrees or at least 50 degrees in some embodiments. Whether or not the curve C is circular it may have a maximum departure D, from a straight line L drawn between the ends 34, 35 of the curve C, of at least 5% of the length of the line L, or at least 10% in some embodiments.

FIG. 5 shows an exemplary geometry of toric primary contact surfaces 29C, 31C of opposed flanges 28C, 30C with respective sets of bolt holes 46, 48. Bolt holes on one of the flanges may be threaded as shown in FIG. 4, or the bolt holes on both flanges may be unthreaded as in FIG. 5. Axes 50, 52 of each respective primary contact surface 29C, 31C are shown. These axes may coincide with an axis of each respective component 54, 56 if the component is a solid of revolution.

FIG. 6 shows exemplary geometry of a flange embodiment 30D on a component 58 that is not a solid of revolution. Whether or not a component is a solid of revolution, the flange extends around a perimeter of the component, and the primary contact surface 31D of the flange is defined by a curve C in a section plane P transverse to a direction of the flange along the perimeter. The perimeter 60 may be at an end of a component as shown or it may be intermediate the ends as later shown. The curve C may have a maximum departure, from a straight line drawn between the ends of the curve, of at least 5% of the length of the line, or at least 10% in some embodiments. In some embodiments, the curve may be a circular arc with a span angle of at least 40 degrees, or at least 50 degrees in some embodiments.

Figure 7:
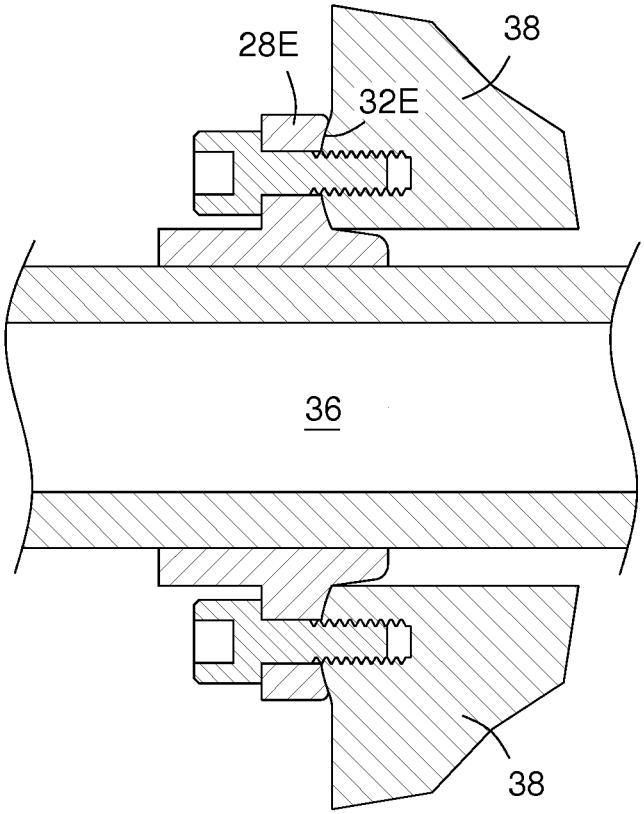
FIG. 7 is a sectional side view of a pilot fuel nozzle bolted by a flange to a combustor head.

FIG. 7 is a sectional side view of a pilot fuel nozzle 36 bolted by a toric flange 28E to a combustor head 38. The toric interface 32E providing precise centering and alignment of the pilot fuel nozzle extending into the combustor. Any flange embodiment herein may extend around a component intermediate the ends of the component as shown here. It is not limited to extending from an end of a component.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A flange comprising:

a primary contact surface defined by a revolution of a curve about an axis, the primary contact surface including a span angle of at least 40 degrees;

at least one bolt hole formed in the primary contact surface;

an annular seal slot for a seal ring defined in the primary contact surface; and the at least one bolt hole and the annular seal slot positioned on the curve within the span angle.

2. The flange of claim 1 wherein the primary contact surface comprises an annular portion of a ring torus.

3. The flange of claim 1 wherein the curve is a circular arc in a plane of said axis.

4. The flange of claim 1, wherein the curve comprises a maximum departure, from a line drawn between an inner circumference and an outer circumference of the primary contact surface in a plane of the axis, of at least 5% of a length of said line.

5. The flange of claim 1, wherein the flange is formed on an outer casing of a combustor of a gas turbine engine for attachment of said outer casing to a further structure of the gas turbine engine.

6. The flange of claim 1, wherein the flange is formed on a pilot fuel nozzle of a combustor of a gas turbine engine for attachment of said pilot fuel nozzle to a further structure of the combustor.

7. A flange attached to and extending around a perimeter of a component, the flange comprising:

a primary contact surface defined by a smooth curve in a section plane transverse to a direction of the flange along the perimeter, the primary contact surface including a span angle of at least 40 degrees;

at least one bolt hole formed in the primary contact surface;

an annular seal slot for a seal ring defined in the primary contact surface;

the at least one bolt hole and the annular seal slot positioned on the curve within the span angle; and wherein the smooth curve comprises a maximum departure, from a straight line drawn between ends of the smooth curve, of at least 5% of the length of the straight line.

8. The flange of claim 7, wherein the smooth curve is a circular arc.

9. The flange of claim 7, wherein the perimeter of the component is circular, and the primary contact surface comprises an annular portion of a torus.

10. The flange of claim 7, wherein the primary contact surface is a surface of revolution of a circular arc, wherein the circular arc has a span angle of at least 40 degrees.

11. The flange of claim 7, wherein the flange is formed on an outer casing of a combustor of a gas turbine engine for attachment of said outer casing to a further structure of the gas turbine engine.

12. The flange of claim 7, wherein the flange encircles a pilot nozzle of a gas turbine combustor for attachment of said pilot nozzle to a further structure of the gas turbine combustor.

13. The flange of claim 7, wherein the component is a gas turbine engine component.

14. An apparatus comprising:

a first flange attached to and extending around a perimeter of a first component;

a first primary contact surface on the first flange defined by a first curve in a section plane transverse to a direction of the first flange along the perimeter of the first component, the first primary contact surface including a span angle of at least 40 degrees;

at least one bolt hole formed in the first primary contact surface;

an annular seal slot for a seal ring defined in the first primary contact surface;

the at least one bolt hole and the annular seal slot positioned on the first curve within the span angle;

wherein said first curve comprises a maximum departure, from a straight line drawn between ends of the first curve, of at least 5% of the length of said straight line.

15. The apparatus of claim 14, further comprising:

a second flange attached to and extending around a perimeter of a second component; and a second primary contact surface on the second flange defined by a second curve as seen in a section plane transverse to a direction of the second flange along the perimeter of the second component;

wherein said first and second primary contact surfaces are mating surfaces defined by said first and second curves respectively.

16. The apparatus of claim 15, the at least one bolt hole further comprising a first and a second plurality of bolt holes in the first and second flanges respectively for bolt connection of the first and second flanges to each other, wherein the first and second components are first and second components of a gas turbine engine.

17. The apparatus of claim 16, wherein the first component is an outer casing of a combustor for a gas turbine engine, and the second component is an engine casing of the gas turbine engine.

18. The apparatus of claim 14, wherein said first curve comprises a maximum departure, from the straight line drawn between the ends of the first curve, of at least 10% of the length of the straight line.

19. The apparatus of claim 15, wherein said first curve is a circular arc with a span angle of at least 40 degrees.

* * * * *